US006053364A

United States Patent [19]

van der Heijden

[11] Patent Number: 6,053,364

[45] Date of Patent: Apr. 25, 2000

[54] DEVICE FOR DISPENSING AN AIR-LIQUID MIXTURE, IN PARTICULAR FOAM, AND OPERATING UNIT INTENDED THEREFOR

[75] Inventor: Edgar Ivo Maria van der Heijden, Alkmaar, Netherlands

[73] Assignee: Airspray N.V., Netherlands

[21] Appl. No.: 09/051,305

[22] PCT Filed: Sep. 30, 1996

[86] PCT No.: PCT/NL96/00378

§ 371 Date: Apr. 3, 1998

§ 102(e) Date: Apr. 3, 1998

[87] PCT Pub. No.: WO97/13585

PCT Pub. Date: Apr. 17, 1997

[30] Foreign Application Priority Data

Oct. 6, 1995 [NL] Netherlands ..... 1001366

[51] Int. Cl.[7] ..... B67D 5/06

[52] U.S. Cl. ..... 222/145.6; 222/190; 222/321.9

[58] Field of Search ..... 222/145.6, 190, 222/321.7, 321.9

[56] References Cited

U.S. PATENT DOCUMENTS

| | | | |
|---|---|---|---|
| 3,359,917 | 12/1967 | Cooprider | 222/321.9 X |
| 5,271,530 | 12/1993 | Uehira et al. | 222/190 |
| 5,443,569 | 8/1995 | Uehira et al. | 222/190 |
| 5,570,819 | 11/1996 | Uehira et al. | 222/190 |
| 5,779,104 | 7/1998 | Reidel | 222/190 |
| 5,813,576 | 9/1998 | Iizuka et al. | 222/190 |

FOREIGN PATENT DOCUMENTS

| | | |
|---|---|---|
| 0 544 549 A1 | 6/1993 | European Pat. Off. . |
| 0 613 728 A2 | 9/1994 | European Pat. Off. . |
| 0 736 462 A1 | 10/1996 | European Pat. Off. . |

*Primary Examiner*—Kenneth Bomberg
*Attorney, Agent, or Firm*—Quarles & Brady LLP

[57] ABSTRACT

Device for dispensing an air-liquid mixture, such as foam, comprising a liquid container and an operating unit, which unit comprises at least a concentric air pump and liquid pump, which each comprise a piston chamber with a piston which is displaceable therein and a inlet and discharge, an operating component for operating the two pumps, which component is integral with the liquid piston and comprises an outflow channel with a dispensing opening, while shut-off device, which make it possible to suck up air or liquid, respectively, and dispense them, are present in the inlet and discharge of the pumps, the air pump comprising a double-acting shut-off device which can be operated actively by the operating component and shuts off both the inlet of air to the air pump and shuts off the discharge of air therefrom, and the air piston is an air piston which can be moved freely at least over a small distance with respect to the operating component.

11 Claims, 5 Drawing Sheets

DEVICE FOR DISPENSING AN AIR-LIQUID MIXTURE, IN PARTICULAR FOAM, AND OPERATING UNIT INTENDED THEREFOR

FIELD OF THE INVENTION

The present invention firstly relates to a device for dispensing an air-liquid mixture, in particular a foam, at least comprising a liquid container and an operating unit, which unit comprises at least an air pump and a liquid pump, which are essentially concentric, and each comprise a piston chamber with a piston which is displaceable therein, while each pump comprises an inlet and a discharge, and an operating component is present for operating the two pumps, which operating component is integral with the piston of the liquid pump, and therein comprises an outflow channel with a dispensing opening, which channel can be connected to the discharge of the pumps, while shut-off means, which make it possible to suck up air or liquid, respectively, into the appropriate piston chambers and to dispense these fluids to the outflow channel, are present in the inlet and discharge of the air and liquid pump, the connection between the outflow channel and the relevant pumps being interrupted while air or liquid is being sucked up, and the air pump comprises a double-acting shut-off device, which shuts off both the inlet of air to the air pump and shuts off the discharge of air therefrom.

DESCRIPTION OF PRIOR ART

A device of this kind is disclosed by EP-A-0 613 728 and is designed to dispense foam. To this end, foam-forming means are present in the outflow channel. Moreover, a mixing chamber is in this case present which can be connected to the discharges of the air and liquid pumps and the outflow channel.

The double-acting shut-off device for the air pump comprises a resilient shut-off component, comprising a cylindrical wall section, an annular outer section which extends outwards from the said cylindrical wall section and an annular inner section which extends inwards from the said wall section. The resilient shut-off component is fastened with the said cylindrical wall section to the inner wall of the air piston.

However, the action of the abovementioned foam-dispensing device is not optimal, since problems may occur during dispensing. Dispensing can be impeded by the double-acting shut-off device sticking to other components of the device. If, during use, a section which has stuck fast suddenly comes loose, uncontrolled pressure differences may occur, which have undesirable consequences. Consequently, a relatively large amount of gas or liquid may suddenly emerge. In both cases, this may lead to contamination and spattering, and therefore to foam being formed incorrectly or not at all. The liquids to be dispensed are often substances which are irritating to the eyes. It will be clear that this uncontrolled dispensing should be avoided. Any sticking of the shut-off device likewise leads to problems with refilling the air piston chamber with air after use.

In addition, the said shut-off device is a so-called passive shut-off device, which is opened by pressure differences generated in the unit. In other words, the shut-off device comprises a combination of two non-return valves. The relevant annular sections of the said shut-off device shut off the inlet and discharge, respectively, of the air piston chamber under a certain prestressing. When the pressure drops or rises suitably, the inlet and discharge, respectively, are connected to the air piston chamber.

SUMMARY OF THE INVENTION

The present invention aims to provide a device of the type mentioned in the introduction which does not have the problems of the prior art device and furthermore has a generally improved action. To this end, the invention has the characteristic that the double-acting shut-off device for the air pump is a shut-off device which can be operated actively by the operating component, and in that the air piston is an air piston which can move freely at least over a short distance with respect to the operating component.

In this way, any problems with sticking and the like are completely eliminated. Dispensing can be carried out in a very controlled manner, since the inlet or discharge, respectively, is opened or closed, respectively, directly at the instant that the operating component is operated. Sudden pressure changes in the outflow channel resulting from the shut-off device sticking therefore do not occur. If any sticking does occur, this sticking is eliminated not by a pressure increase but by a mechanical action. All this will be explained in further detail below in the description of the figures.

The device according to the invention is not limited to dispensing foam, but can likewise be used for dispensing an atomizing liquid. This is achieved by suitable configuration of the outflow channel, whether using a mixing chamber, foam-forming component, etc., or not.

In the rest of the description, however, the device according to the invention will be discussed exclusively with reference to dispensing foam.

In the following description, liquid is intended to mean any flowable material, ranging from water, thin liquids, through to pastes, including suspensions, etc.

Preferably, the double-acting shut-off device is designed in the form of a sealing ring forming part of the operating component, and the piston of the air pump is designed in the form of an annular piston, which is freely movable with respect to the other components, while the operating component additionally comprises a driver, which is situated upstream of the sealing ring, viewed in the intended outflow direction of the air, an inner rim of the annular piston is situated between the sealing ring and the driver, and the driver, along its circumferential edge which can interact with the annular piston, comprises recesses, the sealing ring and the driver being able to interact with one another in a sealing manner in the at-rest position of the operating unit, and the distance in this case between the sealing ring and the driver being larger, at the location of the inner rim of the annular piston, than the thickness of the inner rim of the annular piston, and a connection to the outflow channel can be achieved between the sealing ring and the driver.

In this manner, an actively operable air admission or discharge valve for the air piston chamber is provided, the action of which will be explained in more detail below in the description of the figures.

Advantageously, the opening in the freely movable annular piston is as small as possible, in order to avoid the said piston being pulled out of position (tilted) with respect to the operating component.

In this embodiment of the device according to the invention, the annular piston is freely movable over a small distance, since the latter is driven by the sealing ring when the device is used during dispensing of foam, while the annular piston is returned to the starting position by the driver after use, during the returning movement of the operating unit.

Preferably, an additional driver is situated past the sealing ring, viewed in the intended outflow direction of the air, so that the sealing ring can be clamped between the said driver and the annular piston during dispensing of foam, in order to improve the sealing of the air inlet.

In another advantageous embodiment of the device according to the present invention, the double-acting shut-off device forms a component of the piston of the air pump, the piston of the air pump is designed in the form of an annular piston, which is freely movable with respect to the other components, while the operating component comprises two drivers, between which the annular piston is situated, the first driver, which is situated downstream of the annular piston, viewed in the intended outflow direction, having a larger radial dimension than the other, second driver, one or more air inlet openings are present in the annular piston, which openings are situated between the outer circumference of the first and the second drivers, viewed in the radial direction, and a connection to the outflow channel can be achieved between the drivers.

This embodiment likewise provides an actively operable double-acting shut-off device.

Advantageously, the annular piston comprises two axial, circumferential thickened portions, which are located radially at a distance from one another and extend in opposite directions, a first thickened portion which extends in the intended outflow direction and can interact with the first driver, and a second thickened portion which extends in the opposite direction and can interact with the second driver, the first thickened portion lying further towards the outside, in the radial direction, than the second. It will be clear that the thickened portions may be present, in addition to on the annular piston, also on the relevant drivers, with a corresponding action.

The air piston is preferably manufactured from a resilient material.

In order to improve the positioning of the annular piston, the latter is advantageously connected at least locally to the operating component. However, it should be noted here that it is essential in the device according to the invention that the air piston be freely movable at least over a small distance with respect to the operating component.

In particular, in the device according to the invention a mixing chamber is present for mixing air and liquid, which chamber is connected to the outflow channel, the discharge of the air pump and the discharge of the liquid pump. Preferably, one or more foam-forming components are present in the outflow channel. In this way, the device according to the invention can be made suitable both for dispensing atomizing air-liquid mixtures as well as for dispensing foam.

In a particularly preferred embodiment of the device according to the invention, the liquid piston is a cylindrical component with an inlet side and a discharge side, which component is open on two sides and on the discharge side comprises a seat, with which a sealing element extending into the liquid chamber can interact, and additionally that section of the sealing element which extends into the chamber can interact slidingly with friction with an additional cylindrical component in the liquid piston chamber in order to force the sealing element into the seat during filling of the piston chamber and to force it out of the seat during emptying of the chamber.

Particularly advantageously, the shut-off device in the inlet of the liquid pump is designed in the form of a stopper, which can move freely between two stops in the liquid piston chamber and can interact with a seat in the liquid inlet, which stopper moreover forms the additional cylindrical component.

Thus, according to the invention this shut-off device is likewise designed as an active shut-off device, in contrast to the conventional shut-off devices in accordance with the prior art, which are generally formed by a pressure-sensitive non-return valve, such as a ball or the like in a seat, which can be removed from the seat by a pressure difference. The known sticking phenomena which were discussed in the introduction can of course also occur in these non-return valves in accordance with the prior art.

Furthermore, the invention provides an operating unit which is evidently intended to be used in a device according to the invention.

Finally, a piston is provided which is intended for an air pump for an operating unit according to the invention.

BRIEF DESCRIPTION OF THE DRAWINGS

The invention will be explained in more detail below, with reference to the appended drawing, in which.

DETAILED DESCRIPTION OF THE DRAWINGS

Figure 1:
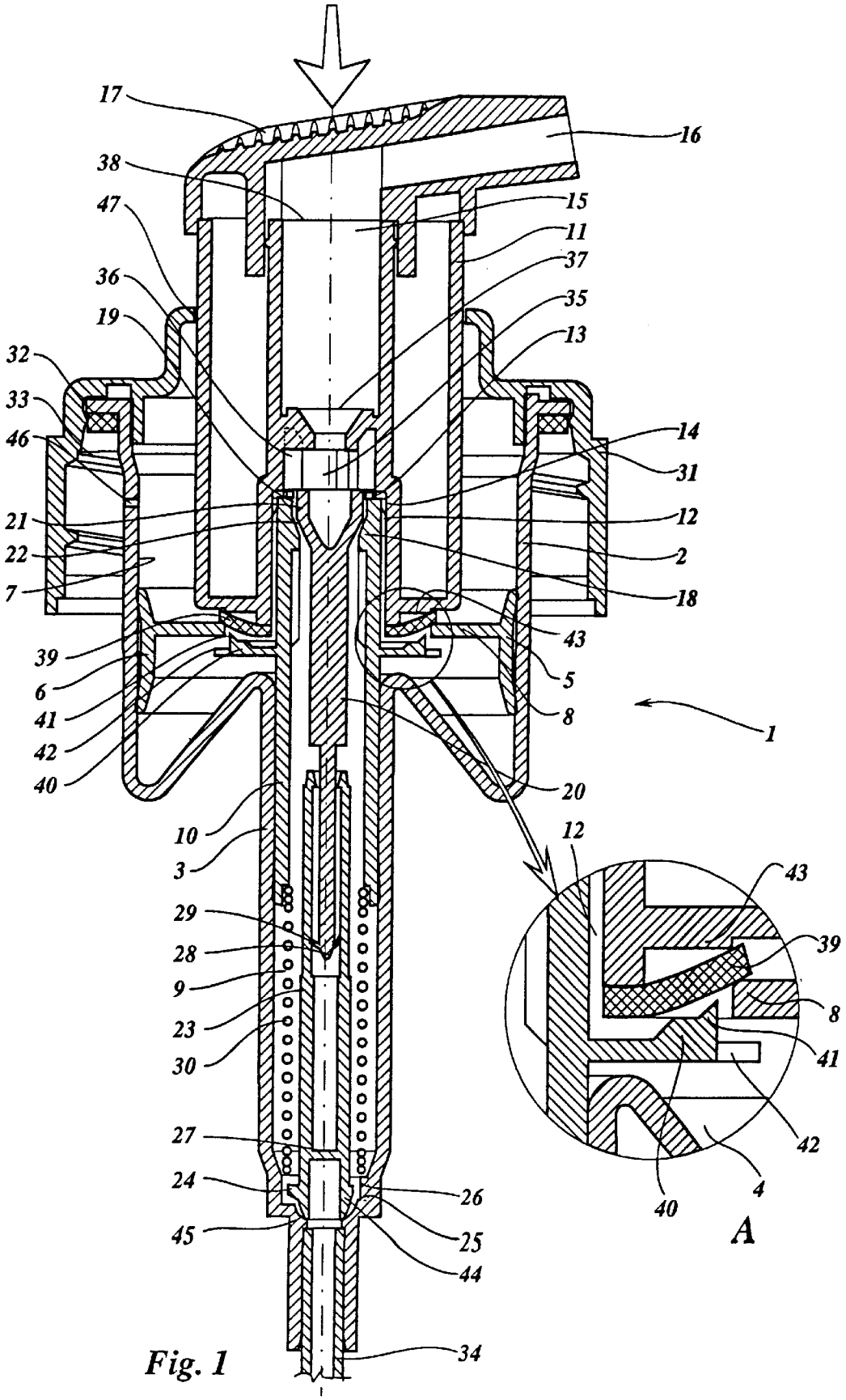
FIG. 1 shows a first embodiment of an operating unit according to the invention during the dispensing of foam.

In FIG. 1, a first embodiment of an operating unit according to the invention is indicated diagrammatically by 1. This operating unit 1 comprises an air pump 2 and a liquid pump 3.

The air pump 2 comprises a piston chamber 4 and an annular air piston 5, which piston 5 is in contact via the ring 6 with an inner wall 7 of the piston chamber 4, and additionally has an annular flat section 8.

The liquid pump 3 comprises a liquid piston chamber 9 with a liquid piston 10. The liquid piston 10 is an essentially cylindrical component which is open on two sides.

The said liquid pump piston 10 is integral with an operating component 11 and is received, with the interposition of suitable ribs 12 and 13, in a recess 14 in the operating component 11. It will be clear that the said ribs 12 and 13, respectively, may be present either on the outside of the end of the piston 10 or also on the inside of the recess 14. The operating component 11 comprises an outflow channel 15 and a dispensing opening 16. The location where the operating component can be operated with the aid of a finger is indicated by 17.

The end of the liquid piston, which is provided with ribs 12 and 13, respectively, and is denoted by reference numeral 18, comprises an opening 22, and forms a seat 19 for a sealing element 20 which extends into the piston chamber 9. The said sealing element 20 can seal the opening 22 in the end 18 by means of a sealing section 21. The sealing element 20 extends on the other side into a stopper 23, which consists of a cylindrical component which is closed on one side and is provided with projections 24, which can move between a shoulder 25 and a stop 26. The closed end of the stopper 23 is denoted by 27. The stopper 23 can seal the inlet opening 45.

The sealing element 20 comprises a number of lips 29 distributed over its circumference at one end 28, in order to assist the engagement between the said element and the component 23 and to increase the frictional resistance.

30 denotes a spring which rests against the stop 26 and is used as a restoring means for the operating component 11.

31 denotes a cover part with a sealing ring 32 and an internal screw thread 33, by means of which the operating unit can be screwed onto an opening in a liquid container.

34 denotes an diptube, the length of which is generally such that it extends to near the bottom of the liquid container.

35 denotes a mixing chamber which is provided on the inside with baffles 36, against which the end 21 of the sealing element 20 can be supported without sealing. 37 and 38 denote foam-forming components made of screen material. This screen material can expediently be chosen from, for example, porous materials, sintered materials, wire gauze screens, etc.

The double-acting shut-off device is formed by the assembly of the annular piston 5, a sealing ring 39 which is fastened to the operating component 11, a driver 40 with a circumferential thickened portion 41 and projections 42, and a driver 43 of the operating component 11. The said shut-off assembly is depicted in more detail in the enlargement A of FIG. 1.

FIG. 1 shows the embodiment during the downward stroke of the operating component 11, liquid being moved by the piston 10 out of the liquid chamber 9, between the section 21 of the sealing component 20 and the seat 22 of the end 18 of the piston chamber and being conveyed to the mixing chamber 35. Air is conveyed, between the sealing ring 39 and the channels formed by the ribs 12 and 13, respectively, and the inner wall of the recess 14, to the mixing chamber 35 by the piston 5. The liquid is struck by a plurality of air flows essentially transversely to the direction of flow. The liquid thus enters the mixing chamber 35 in the form of a cylindrical flow of liquid, as a result of which an outstanding mixing is obtained.

After the air-liquid mixture has passed the foam-forming components 37 and 38 in the outflow channel 15, a foam is dispensed at 16. During the downwards movement of the operating component 11, the spring 30 is compressed and will return to its initial position when the operating component is released.

Furthermore, during the said downward movement of the piston 5, the sealing ring 39 will be pressed against the shoulder 43 as a result of friction between the piston section 6 and the wall 7 of the air pump 2, as a result of which a connection is achieved, between the driver 40 and the sealing ring, with the channel formed by the ribs 12 of the liquid piston 10 and the inner wall of the recess 14 in the operating component, and air can thus flow to the mixing chamber.

Moreover, during the downward movement the sealing element 20 is removed from the seat 22 by interaction between the inner wall of the component 23 and the lips 29 at the end of the said sealing element 20. In this case, the component 23 seals off the connection to the container, via the diptube, and the end 44 of the component 23 is then located in the seat of the opening 45 of the liquid piston chamber inlet. During this movement, the end 21 of the sealing element 20 bears against the baffles 36 in the mixing chamber 35.

Figure 2:
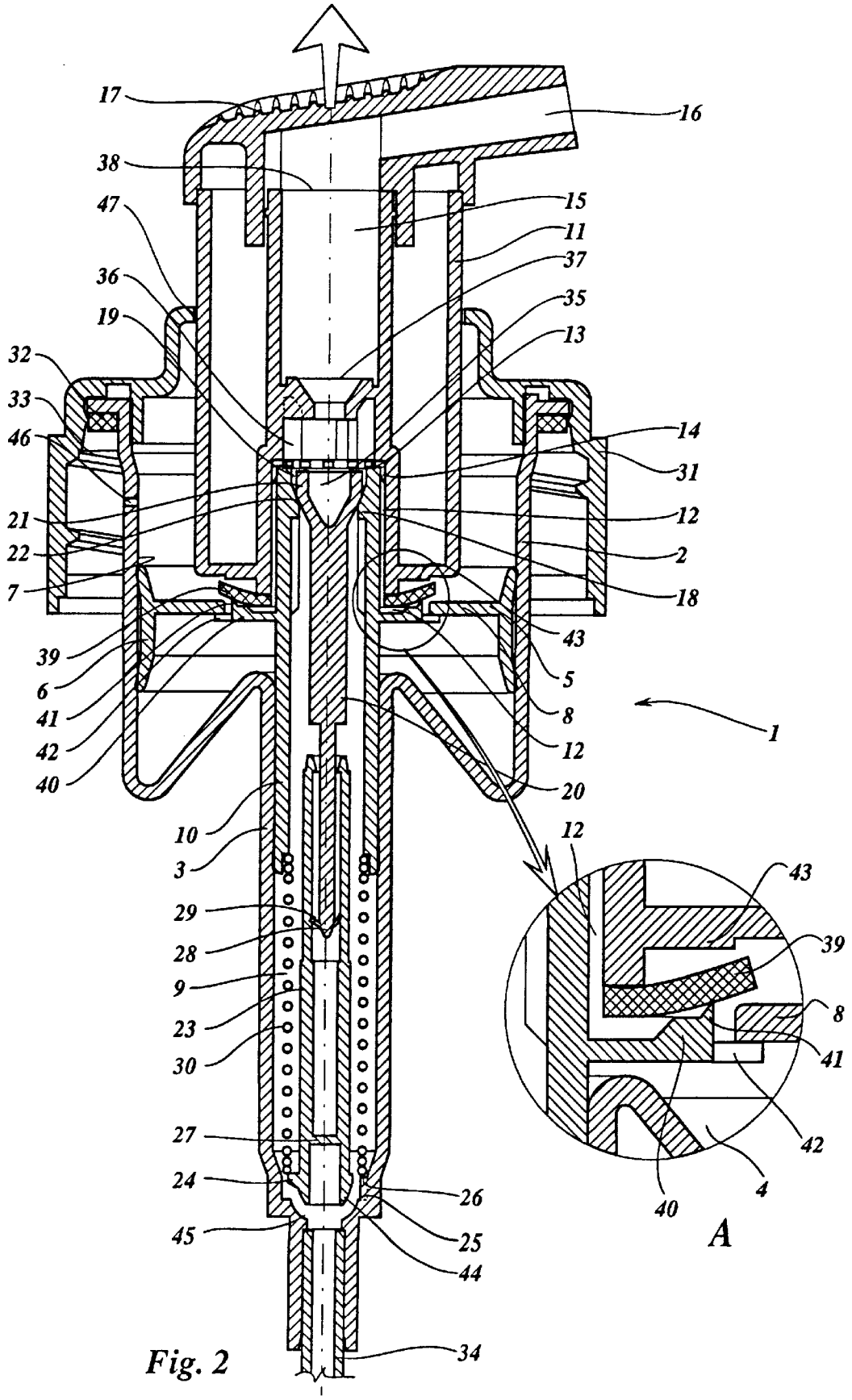
FIG. 2 shows the operating unit according to FIG. 1, but after dispensing, during the return movement.

FIG. 2 shows the operating unit according to FIG. 1 in a position after foam has been dispensed, during the return movement of the operating component 11. During this movement, the annular piston 5 is to a certain extent held back by friction between the section 6 and the wall 7 of the air pump 2, but is driven by the driver 40 or the small projections 42 thereof. During this movement, the annular thickened portion 41 presses the sealing ring 39 from the rim 8 of the annular piston 5, as a result of which the piston chamber 4 is connected to ambient air which can flow in via the passage 47 between the operating component 11 and the fastening cap 31, while the connection with the outflow channel 15 is interrupted. In this position, the distance between the sealing ring 39 and the driver 40 at the location of the inner rim 8 of the annular piston 5 is greater than the thickness of the said inner rim 8, in order to permit sealing between the sealing ring 39 and the driver 40 as well as to enable air to be let into the air piston chamber 4.

During the return movement of the operating component 11, the component 23 is also removed from the seat 45, and in the process the lugs 24 come to bear against the stop 26, it being possible for the liquid to be drawn out of the container, via the diptube, into the liquid piston chamber 9 by the piston 10. During this movement, the section 21 of the sealing element 20 seals the opening 22 by interacting with the seat 19.

A channel 46 is present in the air pump 2, in order to be able to smooth out the pressure changes in the container which arise as a result of liquid being removed therefrom.

It should be pointed out that in the position of rest of the operating unit 1 according to the invention, the discharge of the air pump 2 is closed by the interaction between the sealing ring 39 and the driver 40. As a result, any liquid residues flowing back after use cannot reach the air piston chamber 4.

Figure 3:
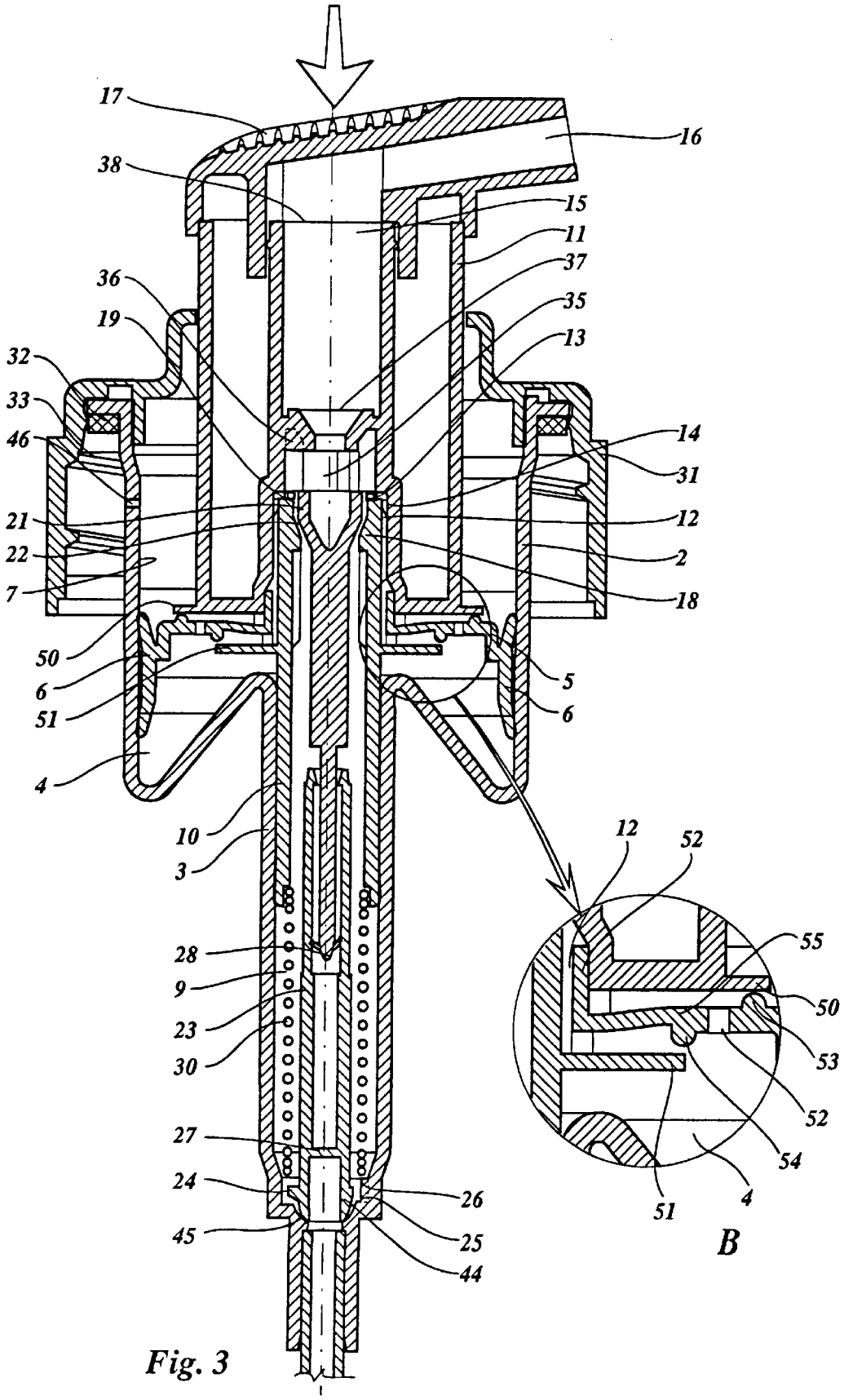
FIG. 3 shows a second embodiment of the operating unit according to the invention during dispensing.

FIG. 3 shows a second embodiment of an operating unit according to the invention which is substantially identical to that of FIG. 1 and 2, the same reference numerals being used for corresponding components. The double-acting shut-off device in this figure is, however, designed differently. The shut-off device is in this case not formed by a separate sealing ring, but here forms a component of the annular piston 5.

The annular piston 5 comprises a cylindrical section 52, which in this case is fastened to the operating component 11 between the lugs 12 and the recess 14 and can move flexibly over some distance with respect to the operating component 11.

It will be clear that this fastening is not, however, necessary, and the annular piston 5 can likewise be used as a separate, loose component in this embodiment.

A section 55 of the annular piston 5 is provided with circumferential thickened portions 53 and 54, between which air inlet openings 52 are situated. The thickened portions 53 and 54 can interact with drivers 50 and 51, respectively, which are respectively present on the operating component 11 and the liquid piston 10. The driver 50 has a larger radial dimension than the driver 51.

In the downward stroke, during the dispensing of foam, the operating unit 11 is situated in the position in accordance with FIG. 3, it being possible for air to move through, between the driver 51 and the thickened portion 54 on the piston section 55, to the channels which are formed by the ribs 12, 13 and the inner wall 14 of the operating component 11.

Figure 4:
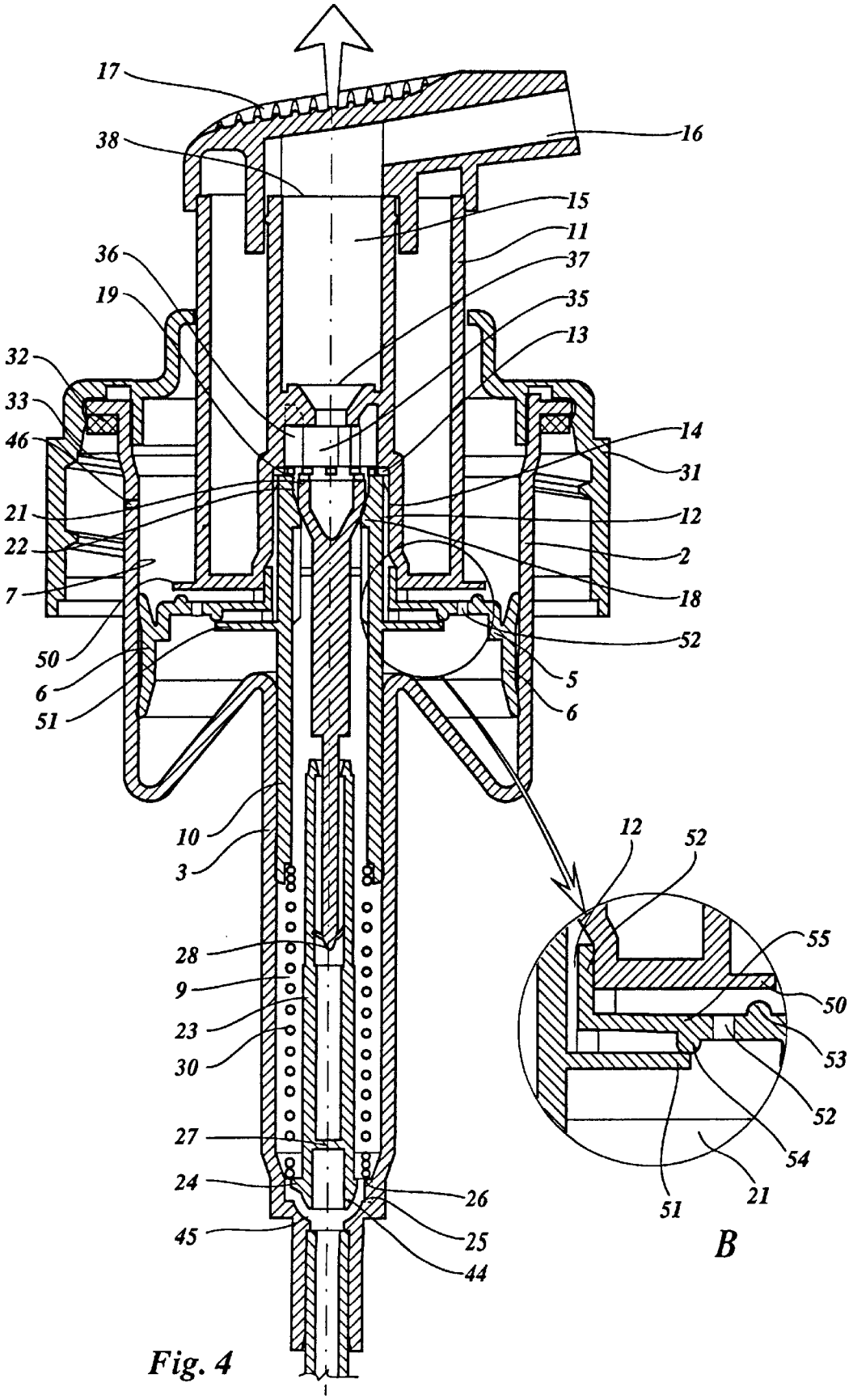
FIG. 4 shows the operating unit according to FIG. 3 after dispensing, during the return movement.

After dispensing, the operating component 11 will be moved back by the spring 30 to the initial position and will then assume the position in accordance with FIG. 4. In this position, air can flow via the intermediate space 47, between the driver 50 and the annular thickened portion 53, and through the inlet openings 52 into the air piston chamber 4.

Figure 5:
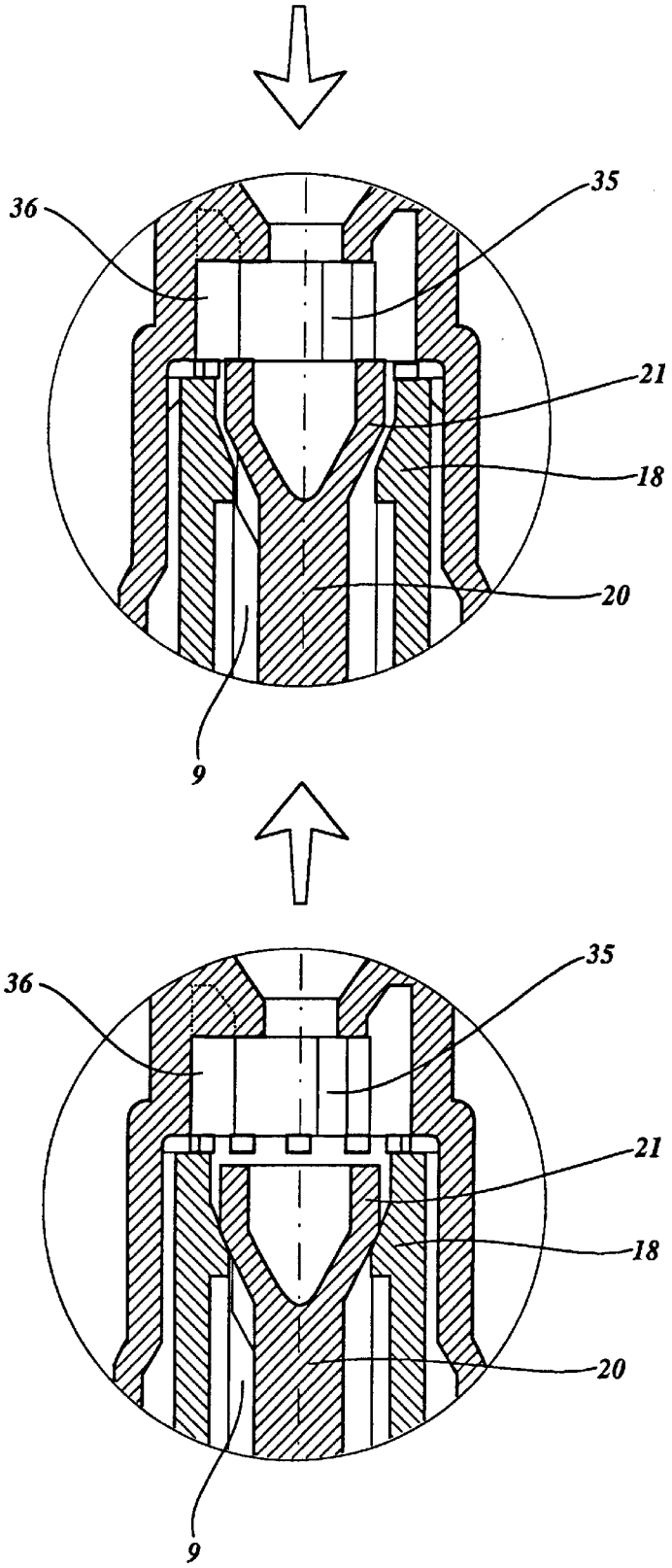
FIG. 5 shows an enlargement of the shut-off device of the discharge of the liquid pump in the operating unit according to the invention in the two operating positions.

Finally, FIG. 5 shows an enlargement of a particular embodiment of the sealing section 21 of the sealing element 20, in the top version during dispensing of liquid from the liquid piston chamber 9 and in the bottom version during filling of the liquid piston chamber 9. The sealing section 21 comprises a number of positioning lugs 56, preferably four, which are distributed over the circumference. Correct positioning of the sealing element 20 and its sealing section 21 with respect to the opening 22 provides a symmetrical cylindrical outflow of liquid which greatly benefits the quality of the foam which is eventually formed. This is particularly important in the case of relatively viscous liquids.

It will be clear that although a circumferential lug is present on the driver in FIGS. 1 and 2, this driver can likewise be of flat design, and a circumferential thickened portion can be arranged on the sealing ring. The same applies to the embodiment in accordance with FIGS. 3 and 4, likewise it being possible for a circumferential thickened portion to be arranged on the relevant drivers instead of thickened portions on the piston. A similar action is thus obtained.

Sticking of shut-off devices or the like no longer plays any role in the operating unit according to the invention, since the double-acting shut-off device is operated actively by the operating component and is opened and closed, respectively, irrespective of pressure differences occurring.

I claim:

1. Device for dispensing an air-liquid mixture, comprising:

a liquid container and an operating unit, said operating unit including:

an air pump a liquid pump, each said pumps being concentric, and each said pumps including a piston chamber and a piston displaceable therein, each said pumps comprise an inlet and a discharge, an operating component for operating said two pumps, said operating component being integral with the piston of the liquid pump, and therein defining an outflow channel having a dispensing opening, said channel connectable to said discharge of said pumps, and air pump shut-off means for sucking up air into the piston chamber of said air pump and to dispense air to the outflow channel, said air pump shut-off means present in the inlet and discharge of the air pump, liquid pump shut-off means for sucking up liquid into the piston chamber of said liquid pump an to dispense liquid to the outflow channel, said liquid pump shut-off means present in the inlet and discharge of the liquid pump, the connection between the outflow channel and the air pump being interrupted while air is being sucked up, the connection between the outflow channel and the liquid pump being interrupted liquid is being sucked up, and the air pump comprises a double-acting shut-off device, said shut-off device shuts off both the inlet of air to the air pump and shuts off the discharge of air therefrom, said double-acting shut-off operable actively by the operating component, said air piston movable freely over a short distance with respect to the operating component.

2. Device according to claim 1, wherein the double-acting shut-off device is a sealing ring forming part of the operating component, and the piston of the air pump is an annular piston freely movable, the operating component additionally comprises a driver situated upstream of the sealing ring, viewed in the intended outflow direction of the air, an inner rim of the annular piston is situated between the sealing ring and the driver, and the driver, along its circumferential edge interactable with the annular piston, comprises recesses, the sealing ring and the driver able to interact with one another in a sealing manner in the at-rest position of the operating unit, the distance between the sealing ring and the driver being larger, at the location of the inner rim of the annular piston, than the thickness of the inner rim of the annular piston, and thereby affecting a connection to the outflow channel between the sealing ring and the driver.

3. Device according to claim 2, wherein the central opening in the freely movable annular piston has a size preventing said piston being tilted with respect to said operating component.

4. Device according to claim 2, further comprising an additional driver on the operating component downstream of the sealing ring, viewed in the outflow direction.

5. Device according to claim 1, wherein the double-acting shut-off device is a component of the piston of the air pump, the piston of the air pump being an annular piston freely movable, the operating component comprises two drivers, between which the annular piston is situated, the first driver, which is situated downstream of the annular piston, viewed in the intended outflow direction, having a larger radial dimension than the second driver, one or more air inlet openings are present in the annular piston, said air inlet openings situated between the outer circumference of the first and the second drivers, viewed in the radial direction, thereby making a connection to the outflow channel between the drivers.

6. Device according to claim 5, wherein the annular piston comprises two axial, circumferential thickened portions located radially at a distance from one another and extend in opposite directions, a first thickened portion extends in the outflow direction and is interactable with the first driver, and a second thickened portion extends in the opposite direction and is interactable with the second driver, the first thickened portion lying further towards the outside, in the radial direction, than the second.

7. Device according to claim 1, wherein the annular piston is coupled locally to the operating component thereby being movable.

8. Device according to claim 1, further comprising a mixing chamber for mixing air and liquid, said chamber connected to the outflow channel, the discharge of the air pump and the discharge of the liquid pump.

9. Device according to claim 1, further comprising at least one foam-forming components in the outflow channel.

10. Device according to claim 1 wherein the liquid piston is a cylindrical component with an inlet side and a discharge side, said component being open on two sides and on the discharge side comprises a seat interactable with a sealing element extending into the liquid chamber, the section of the sealing element extending into the chamber interactable slidingly with friction with an additional cylindrical component in the liquid piston chamber to force the sealing element into the seat during filling of the piston chamber and to force the sealing element out of the seat during emptying of the chamber.

11. Device according to claim 1, wherein the shut-off device in the inlet of the liquid pump is of a stopper freely movable between two stops in the liquid piston chamber and interactable with a seat in the liquid inlet, said stopper forming the additional cylindrical component.

* * * * *